US009837711B2

(12) United States Patent
Shtrom et al.

(10) Patent No.: US 9,837,711 B2
(45) Date of Patent: Dec. 5, 2017

(54) ANTENNA WITH SELECTABLE ELEMENTS FOR USE IN WIRELESS COMMUNICATIONS

(75) Inventors: Victor Shtrom, Sunnyvale, CA (US); William S. Kish, Saratoga, CA (US)

(73) Assignee: Ruckus Wireless, Inc., Sunnyvale, CA (US)

( * ) Notice: Subject to any disclaimer, the term of this patent is extended or adjusted under 35 U.S.C. 154(b) by 0 days.

(21) Appl. No.: 12/980,253

(22) Filed: Dec. 28, 2010

(65) Prior Publication Data

US 2011/0095960 A1 Apr. 28, 2011

Related U.S. Application Data

(60) Division of application No. 11/877,465, filed on Oct. 23, 2007, which is a continuation of application No.
(Continued)

(51) Int. Cl.
*H01Q 3/24* (2006.01)
*H01Q 9/28* (2006.01)
(Continued)

(52) U.S. Cl.
CPC ..... *H01Q 3/24* (2013.01); *H01Q 1/38* (2013.01); *H01Q 9/285* (2013.01);
(Continued)

(58) Field of Classification Search
CPC H01Q 3/24; H01Q 1/38; H01Q 3/242; H01Q 9/285; H01Q 21/062; H01Q 21/24; H01Q 21/26; H01Q 21/29
(Continued)

(56) References Cited

U.S. PATENT DOCUMENTS 723,188 A 3/1903 Tesla
725,605 A 4/1903 Tesla
(Continued)

FOREIGN PATENT DOCUMENTS

AU 2003/227399 10/2003
CA 02494982 10/2003
(Continued)

OTHER PUBLICATIONS

U.S. Appl. No. 61/043,556, filed Aug. 15, 2000, Hikuma et al.
(Continued)

*Primary Examiner* — Robert Karacsony
(74) *Attorney, Agent, or Firm* — Lewis Roca Rothgerber Christie LLP

(57) ABSTRACT

A system and method for a wireless link to a remote receiver includes a communication device for generating RF and a planar antenna apparatus for transmitting the RF. The planar antenna apparatus includes selectable antenna elements, each of which has gain and a directional radiation pattern. The directional radiation pattern is substantially in the plane of the antenna apparatus. Switching different antenna elements results in a configurable radiation pattern. Alternatively, selecting all or substantially all elements results in an omnidirectional radiation pattern. One or more directors and/or one or more reflectors may be included to constrict the directional radiation pattern. The antenna apparatus may be conformally mounted to a housing containing the communication device and the antenna apparatus.

20 Claims, 5 Drawing Sheets

Related U.S. Application Data

11/010,076, filed on Dec. 9, 2004, now Pat. No. 7,292,198.

(60) Provisional application No. 60/602,711, filed on Aug. 18, 2004, provisional application No. 60/603,157, filed on Aug. 18, 2004.

(51) Int. Cl.

| | |
|---|---|
| ***H01Q 1/38*** | (2006.01) |
| ***H01Q 21/24*** | (2006.01) |
| ***H01Q 21/29*** | (2006.01) |
| ***H01Q 21/26*** | (2006.01) |
| ***H01Q 21/20*** | (2006.01) |
| ***H01Q 21/06*** | (2006.01) |

(52) U.S. Cl.
CPC ..... *H01Q 21/062* (2013.01); *H01Q 21/205* (2013.01); *H01Q 21/24* (2013.01); *H01Q 21/26* (2013.01); *H01Q 21/29* (2013.01)

(58) Field of Classification Search
USPC ..... 343/700 MS, 702, 709, 729, 824, 891, 343/895, 894
See application file for complete search history.

(56) References Cited

U.S. PATENT DOCUMENTS 1,869,659 A 8/1932 Broertjes
2,292,387 A 8/1942 Markey et al.
3,488,445 A 1/1970 Chang
3,488,455 A 1/1970 Chang
3,568,105 A 3/1971 Felsenheld
3,721,990 A 3/1973 Gibson et al.
3,887,925 A 6/1975 Ranghelli
3,967,067 A 6/1976 Potter
3,969,730 A 7/1976 Fuchser
3,982,214 A 9/1976 Burns
3,991,273 A 11/1976 Mathes
4,001,734 A 1/1977 Burns
4,027,307 A 5/1977 Litchford
4,176,356 A 11/1979 Foster et al.
4,193,077 A 3/1980 Greenberg et al.
4,203,118 A 5/1980 Alford
4,253,193 A 2/1981 Kennard
4,305,052 A 12/1981 Baril et al.
4,513,412 A 4/1985 Cox
4,554,554 A 11/1985 Olesen et al.
4,733,203 A 3/1988 Ayasli
4,764,773 A 8/1988 Larsen et al.
4,800,393 A 1/1989 Edward et al.
4,814,777 A 3/1989 Monser
4,821,040 A 4/1989 Johnson et al.
4,920,285 A 4/1990 Clark et al.
4,937,585 A 6/1990 Shoemaker
5,063,574 A 11/1991 Moose
5,097,484 A 3/1992 Akaiwa
5,173,711 A 12/1992 Takeuchi et al.
5,203,010 A 4/1993 Felix
5,208,564 A 5/1993 Burns et al.
5,220,340 A 6/1993 Shafai
5,241,693 A 8/1993 Kim
5,282,222 A 1/1994 Fattouche et al.
5,291,289 A 3/1994 Hulyalkar et al.
5,311,550 A 5/1994 Fouche et al.
5,337,066 A 8/1994 Hirata et al.
5,373,548 A 12/1994 McCarthy
5,434,575 A 7/1995 Jelinek
5,453,752 A 9/1995 Wang et al.
5,479,176 A 12/1995 Zavrel
5,507,035 A 4/1996 Bantz
5,532,708 A 7/1996 Krenz et al.
5,559,800 A 9/1996 Mousseau et al.
5,726,666 A 3/1998 Hoover et al.
5,754,145 A 5/1998 Evans
5,767,755 A 6/1998 Kim et al.
5,767,807 A 6/1998 Prtichett
5,767,809 A 6/1998 Chuang et al.
5,786,793 A 7/1998 Maeda et al.
5,802,312 A 9/1998 Lazaridis et al.
5,828,346 A 10/1998 Park
5,936,595 A 8/1999 Wang
5,964,830 A 10/1999 Durrett
5,966,102 A 10/1999 Runyon
5,990,838 A 11/1999 Burns et al.
6,005,519 A * 12/1999 Burns ..... H01Q 1/38 343/700 MS
6,005,525 A 12/1999 Kivela
6,011,450 A 1/2000 Miya
6,023,250 A 2/2000 Cronyn
6,031,503 A 2/2000 Preiss, II et al.
6,034,638 A 3/2000 Thiel et al.
6,046,703 A 4/2000 Wang
6,052,093 A 4/2000 Yao et al.
6,061,025 A * 5/2000 Jackson ..... H01Q 1/38 343/700 MS
6,067,053 A 5/2000 Runyon et al.
6,091,364 A 7/2000 Murakami et al.
6,094,177 A 7/2000 Yamamoto
6,097,347 A 8/2000 Duan et al.
6,104,356 A 8/2000 Hikuma et al.
6,169,523 B1 1/2001 Ploussios
6,249,216 B1 * 6/2001 Flick ..... 340/426.14
6,266,528 B1 7/2001 Farzaneh
6,281,762 B1 8/2001 Nakao
6,288,682 B1 9/2001 Thiel et al.
6,292,153 B1 9/2001 Aiello et al.
6,307,524 B1 10/2001 Britain
6,317,599 B1 11/2001 Rappaport et al.
6,323,810 B1 11/2001 Poilasne et al.
6,326,922 B1 12/2001 Hegendoerfer
6,326,924 B1 12/2001 Muramoto et al.
6,337,628 B2 1/2002 Campana, Jr.
6,337,668 B1 1/2002 Ito et al.
6,339,404 B1 1/2002 Johnson
6,345,043 B1 2/2002 Hsu
6,351,240 B1 2/2002 Karimullah et al.
6,356,242 B1 3/2002 Ploussios
6,356,243 B1 3/2002 Schneider et al.
6,356,905 B1 3/2002 Gershman et al.
6,366,254 B1 4/2002 Sivenpiper
6,377,227 B1 4/2002 Zhu et al.
6,392,610 B1 5/2002 Braun et al.
6,396,456 B1 5/2002 Chiang et al.
6,400,329 B1 6/2002 Barnes
6,404,386 B1 6/2002 Proctor, Jr. et al.
6,407,719 B1 6/2002 Ohira et al.
RE37,802 E 7/2002 Fattouche et al.
6,414,647 B1 7/2002 Lee
6,424,311 B1 7/2002 Tsai et al.
6,442,507 B1 8/2002 Skidmore et al.
6,445,688 B1 9/2002 Garces et al.
6,456,242 B1 9/2002 Crawford
6,476,773 B2 11/2002 Palmer
6,492,957 B2 * 12/2002 Carillo et al. ..... 343/841
6,493,679 B1 12/2002 Rappaport et al.
6,496,083 B1 12/2002 Kushitani et al.
6,498,589 B1 12/2002 Horii
6,499,006 B1 12/2002 Rappaport et al.
6,507,321 B2 1/2003 Oberschmidt et al.
6,521,422 B1 2/2003 Hsu
6,531,985 B1 3/2003 Jones et al.
6,545,643 B1 * 4/2003 Sward et al. ..... 343/702
6,583,765 B1 6/2003 Schamberget et al.
6,586,786 B2 7/2003 Kitazawa et al.
6,593,891 B2 7/2003 Zhang
6,606,059 B1 * 8/2003 Barabash ..... 343/700 MS
6,611,230 B2 8/2003 Phelan
6,621,029 B2 9/2003 Galmiche
6,625,454 B1 9/2003 Rappaport et al.
6,633,206 B1 10/2003 Kato
6,642,889 B1 11/2003 McGrath
6,642,890 B1 11/2003 Chen

(56) References Cited

U.S. PATENT DOCUMENTS 6,674,459 B2 1/2004 Ben-Shachar et al.
6,700,546 B2 3/2004 Benhammou et al.
6,701,522 B1 3/2004 Rubin et al.
6,724,346 B2 4/2004 Le Bolzer
6,725,281 B1 4/2004 Zintel et al.
6,741,219 B2 5/2004 Shor
6,747,605 B2 6/2004 Lebaric
6,753,814 B2 6/2004 Killen et al.
6,757,267 B1 6/2004 Evans
6,762,723 B2 7/2004 Nallo et al.
6,774,852 B2 8/2004 Chiang et al.
6,774,864 B2 8/2004 Evans
6,779,004 B1 8/2004 Zintel et al.
6,819,287 B2 11/2004 Sullivan et al.
6,822,617 B1 11/2004 Mather et al.
6,839,038 B2 1/2005 Weinstein
6,859,176 B2 2/2005 Choi
6,859,182 B2 2/2005 Horii
6,864,852 B2 3/2005 Chiang et al.
6,876,280 B2 4/2005 Nakano
6,876,836 B2 4/2005 Lin
6,879,293 B2 4/2005 Sato
6,888,504 B2 5/2005 Chiang et al.
6,888,893 B2 5/2005 Li et al.
6,892,230 B1 5/2005 Gu et al.
6,894,653 B2 5/2005 Chiang et al.
6,903,686 B2 6/2005 Vance et al.
6,906,678 B2 6/2005 Chen
6,910,068 B2 6/2005 Zintel et al.
6,914,566 B2 7/2005 Beard
6,914,581 B1 7/2005 Popek
6,924,768 B2 8/2005 Wu et al.
6,931,429 B2 8/2005 Gouge et al.
6,933,907 B2 8/2005 Shirosaka
6,941,143 B2 9/2005 Mathur
6,943,749 B2 9/2005 Paun
6,950,019 B2 9/2005 Bellone et al.
6,950,069 B2 9/2005 Gaucher et al.
6,961,028 B2 11/2005 Joy et al.
6,965,353 B2 11/2005 Shirosaka et al.
6,973,622 B1 12/2005 Rappaport et al.
6,975,834 B1 12/2005 Forster
6,980,782 B1 12/2005 Braun et al.
7,023,909 B1 4/2006 Adams et al.
7,024,225 B2 4/2006 Ito
7,034,769 B2 4/2006 Surducan et al.
7,034,770 B2 4/2006 Yang et al.
7,043,277 B1 5/2006 Pfister
7,046,201 B2 5/2006 Okada
7,050,809 B2 5/2006 Lim
7,053,844 B2 5/2006 Gaucher et al.
7,064,717 B2 6/2006 Kaluzni
7,085,814 B1 8/2006 Gandhi et al.
7,088,299 B2 8/2006 Siegler et al.
7,088,306 B2 8/2006 Chiang et al.
7,089,307 B2 8/2006 Zintel et al.
7,098,863 B2 8/2006 Bancroft
D530,325 S 10/2006 Kerila
7,120,405 B2 10/2006 Rofougaran
7,130,895 B2 10/2006 Zintel et al.
7,148,846 B2 12/2006 Qi et al.
7,162,273 B1 1/2007 Ambramov et al.
7,164,380 B2 1/2007 Saito
7,171,475 B2 1/2007 Weisman et al.
7,193,562 B2 3/2007 Shtrom
7,206,610 B2 4/2007 Iacono et al.
7,215,296 B2 5/2007 Ambramov et al.
7,277,063 B2 10/2007 Shirosaka et al.
7,292,198 B2 11/2007 Shtrom
7,292,870 B2 11/2007 Heredia et al.
7,295,825 B2 11/2007 Raddant
7,298,228 B2 11/2007 Sievenpiper
7,312,762 B2 12/2007 Puente Ballarda et al.
7,319,432 B2 1/2008 Andersson
7,333,460 B2 2/2008 Vaisanen
7,358,912 B1 4/2008 Kish et al.
7,362,280 B2 4/2008 Shtrom
7,385,563 B2 6/2008 Bishop
7,498,999 B2 3/2009 Shtrom
7,511,680 B2 3/2009 Shtrom et al.
7,522,569 B2 4/2009 Rada
7,525,486 B2 4/2009 Shtrom
7,609,648 B2 * 10/2009 Hoffmann et al. ..... 370/252
7,697,550 B2 4/2010 Rada
7,733,275 B2 6/2010 Hirota
7,782,895 B2 8/2010 Pasanen et al.
7,835,697 B2 11/2010 Wright
7,847,741 B2 12/2010 Hirota
7,864,119 B2 1/2011 Shtrom et al.
7,893,882 B2 2/2011 Shtrom
7,916,463 B2 3/2011 Aya et al.
8,068,068 B2 11/2011 Kish et al.
8,085,206 B2 12/2011 Shtrom
8,217,843 B2 7/2012 Shtrom
8,355,912 B1 1/2013 Keesey et al.
8,358,248 B2 1/2013 Shtrom
8,686,905 B2 4/2014 Shtrom
8,704,720 B2 4/2014 Kish
8,723,741 B2 5/2014 Shtrom
8,756,668 B2 6/2014 Ranade et al.
8,836,606 B2 9/2014 Kish et al.
9,019,165 B2 4/2015 Shtrom
9,093,758 B2 7/2015 Kish
2001/0046848 A1 11/2001 Kenkel
2002/0031130 A1 3/2002 Tsuchiya et al.
2002/0036586 A1 3/2002 Gothard et al.
2002/0047800 A1 4/2002 Proctor, Jr. et al.
2002/0080767 A1 6/2002 Lee
2002/0084942 A1 7/2002 Tsai et al.
2002/0101377 A1 8/2002 Crawford
2002/0105471 A1 8/2002 Kojima et al.
2002/0112058 A1 8/2002 Weisman et al.
2002/0119757 A1 8/2002 Hamabe
2002/0158798 A1 10/2002 Chiang et al.
2002/0163473 A1 11/2002 Koyama et al.
2002/0170064 A1 11/2002 Monroe et al.
2003/0026240 A1 2/2003 Eyuboglu et al.
2003/0030588 A1 2/2003 Kalis et al.
2003/0038698 A1 * 2/2003 Hirayama ..... 336/200
2003/0063591 A1 4/2003 Leung et al.
2003/0122714 A1 7/2003 Wannagot et al.
2003/0169330 A1 9/2003 Ben-Shachar et al.
2003/0174099 A1 9/2003 Bauer et al.
2003/0184490 A1 10/2003 Raiman et al.
2003/0184492 A1 10/2003 Chiang et al.
2003/0189514 A1 10/2003 Miyano et al.
2003/0189521 A1 10/2003 Yamamoto et al.
2003/0189523 A1 10/2003 Ojantakanen et al.
2003/0210207 A1 11/2003 Suh et al.
2003/0214446 A1 11/2003 Shehab
2003/0227414 A1 12/2003 Saliga et al.
2004/0014432 A1 1/2004 Boyle
2004/0017310 A1 1/2004 Vargas-Hurlston et al.
2004/0017315 A1 1/2004 Fang et al.
2004/0017860 A1 1/2004 Liu
2004/0027291 A1 2/2004 Zhang et al.
2004/0027304 A1 2/2004 Chiang et al.
2004/0030900 A1 2/2004 Clark
2004/0032378 A1 2/2004 Volman et al.
2004/0036651 A1 2/2004 Toda
2004/0036654 A1 2/2004 Hsieh
2004/0041732 A1 3/2004 Aikawa et al.
2004/0048593 A1 3/2004 Sano
2004/0058690 A1 3/2004 Ratzel et al.
2004/0061653 A1 4/2004 Webb et al.
2004/0070543 A1 4/2004 Masaki
2004/0075609 A1 4/2004 Li
2004/0080455 A1 4/2004 Lee
2004/0090371 A1 5/2004 Rossman
2004/0095278 A1 5/2004 Kanemoto et al.
2004/0114535 A1 6/2004 Hoffmann et al.
2004/0125777 A1 7/2004 Doyle et al.
2004/0145528 A1 7/2004 Mukai et al.
2004/0153647 A1 8/2004 Rotholtz et al.

(56) References Cited

U.S. PATENT DOCUMENTS

| | | | |
|---|---|---|---|
| 2004/0160376 | A1 | 8/2004 | Hornsby et al. |
| 2004/0190477 | A1 | 9/2004 | Olson et al. |
| 2004/0203347 | A1 | 10/2004 | Nguyen |
| 2004/0207563 | A1 | 10/2004 | Yang |
| 2004/0227669 | A1 | 11/2004 | Okada |
| 2004/0260800 | A1 | 12/2004 | Gu et al. |
| 2005/0022210 | A1 | 1/2005 | Zintel et al. |
| 2005/0041739 | A1 | 2/2005 | Li et al. |
| 2005/0042988 | A1 | 2/2005 | Hoek et al. |
| 2005/0048934 | A1 | 3/2005 | Rawnick et al. |
| 2005/0050352 | A1 | 3/2005 | Narayanaswami et al. |
| 2005/0062649 | A1 | 3/2005 | Chiang et al. |
| 2005/0074018 | A1 | 4/2005 | Zintel et al. |
| 2005/0097503 | A1 | 5/2005 | Zintel et al. |
| 2005/0122265 | A1 | 6/2005 | Gaucher et al. |
| 2005/0128983 | A1 | 6/2005 | Kim et al. |
| 2005/0128988 | A1 | 6/2005 | Simpson |
| 2005/0135480 | A1 | 6/2005 | Li et al. |
| 2005/0138137 | A1 | 6/2005 | Encarnacion et al. |
| 2005/0138193 | A1 | 6/2005 | Encarnacion et al. |
| 2005/0146475 | A1 | 7/2005 | Bettner et al. |
| 2005/0180381 | A1 | 8/2005 | Retzer et al. |
| 2005/0184920 | A1 | 8/2005 | Mahler et al. |
| 2005/0188193 | A1 | 8/2005 | Kuehnel et al. |
| 2005/0237258 | A1 | 10/2005 | Abramov et al. |
| 2005/0240665 | A1 | 10/2005 | Gu et al. |
| 2005/0267935 | A1 | 12/2005 | Gandhi et al. |
| 2006/0031922 | A1 | 2/2006 | Sakai |
| 2006/0038734 | A1 | 2/2006 | Shtrom et al. |
| 2006/0050005 | A1 | 3/2006 | Shirosaka et al. |
| 2006/0094371 | A1 | 5/2006 | Nguyen |
| 2006/0098607 | A1 | 5/2006 | Zeng et al. |
| 2006/0109191 | A1 | 5/2006 | Shtrom |
| 2006/0111902 | A1 | 5/2006 | Julia et al. |
| 2006/0123124 | A1 | 6/2006 | Weisman et al. |
| 2006/0123125 | A1 | 6/2006 | Weisman et al. |
| 2006/0123455 | A1 | 6/2006 | Pai et al. |
| 2006/0168159 | A1 | 7/2006 | Weisman et al. |
| 2006/0184660 | A1 | 8/2006 | Rao et al. |
| 2006/0184661 | A1 | 8/2006 | Weisman et al. |
| 2006/0184693 | A1 | 8/2006 | Rao et al. |
| 2006/0224690 | A1 | 10/2006 | Falkenburg et al. |
| 2006/0225107 | A1 | 10/2006 | Seetharaman et al. |
| 2006/0227062 | A1 | 10/2006 | Francque et al. |
| 2006/0227761 | A1 | 10/2006 | Scott, III et al. |
| 2006/0239369 | A1 | 10/2006 | Lee |
| 2006/0251256 | A1 | 11/2006 | Asokan et al. |
| 2006/0262015 | A1 | 11/2006 | Thornell-Pers et al. |
| 2006/0291434 | A1 | 12/2006 | Gu et al. |
| 2007/0027622 | A1 | 2/2007 | Cleron et al. |
| 2007/0037619 | A1 | 2/2007 | Matsunaga et al. |
| 2007/0115180 | A1 | 5/2007 | Kish et al. |
| 2007/0124490 | A1 | 5/2007 | Kalavade et al. |
| 2007/0130294 | A1 | 6/2007 | Nishio |
| 2007/0135167 | A1 | 6/2007 | Liu |
| 2008/0060064 | A1 | 3/2008 | Wynn et al. |
| 2008/0062058 | A1 | 3/2008 | Bishop |
| 2008/0075280 | A1 | 3/2008 | Ye et al. |
| 2008/0096492 | A1 | 4/2008 | Yoon |
| 2008/0109657 | A1 | 5/2008 | Bajaj et al. |
| 2008/0136715 | A1 | 6/2008 | Shtrom |
| 2008/0212535 | A1 | 9/2008 | Karaoguz et al. |
| 2008/0272977 | A1 | 11/2008 | Gaucher et al. |
| 2009/0005005 | A1 | 1/2009 | Forstall et al. |
| 2009/0103731 | A1 | 4/2009 | Sarikaya |
| 2009/0187970 | A1 | 7/2009 | Mower et al. |
| 2009/0217048 | A1 | 8/2009 | Smith |
| 2009/0219903 | A1 | 9/2009 | Alamouti et al. |
| 2009/0295648 | A1 | 12/2009 | Dorsey et al. |
| 2009/0315794 | A1 | 12/2009 | Alamouti et al. |
| 2010/0053023 | A1 | 3/2010 | Shtrom |
| 2010/0103065 | A1 | 4/2010 | Shtrom et al. |
| 2010/0103066 | A1 | 4/2010 | Shtrom et al. |
| 2010/0299518 | A1 | 11/2010 | Viswanathan et al. |
| 2010/0332828 | A1 | 12/2010 | Goto |
| 2011/0007705 | A1 | 1/2011 | Buddhikot et al. |
| 2011/0040870 | A1 | 2/2011 | Wynn et al. |
| 2011/0047603 | A1 | 2/2011 | Gordon et al. |
| 2011/0126016 | A1 | 5/2011 | Sun |
| 2011/0208866 | A1 | 8/2011 | Marmolejo-Meillon et al. |
| 2012/0030466 | A1 | 2/2012 | Yamaguchi |
| 2012/0054338 | A1 | 3/2012 | Ando |
| 2012/0089845 | A1 | 4/2012 | Raleigh |
| 2012/0098730 | A1 | 4/2012 | Kish |
| 2012/0134291 | A1 | 5/2012 | Raleigh |
| 2012/0257536 | A1 | 10/2012 | Kholaif et al. |
| 2012/0284785 | A1 | 11/2012 | Salkintzis et al. |
| 2012/0299772 | A1 | 11/2012 | Shtrom |
| 2012/0322035 | A1 | 12/2012 | Julia et al. |
| 2013/0038496 | A1 | 2/2013 | Shtrom |
| 2013/0047218 | A1 | 2/2013 | Smith |
| 2013/0182693 | A1 | 7/2013 | Sperling et al. |
| 2013/0207865 | A1 | 8/2013 | Shtrom |
| 2013/0207866 | A1 | 8/2013 | Shtrom |
| 2013/0207877 | A1 | 8/2013 | Shtrom |
| 2013/0212656 | A1 | 8/2013 | Ranade et al. |
| 2013/0241789 | A1 | 9/2013 | Shtrom |
| 2013/0269008 | A1 | 10/2013 | Sheu et al. |
| 2014/0210681 | A1 | 7/2014 | Shtrom |
| 2014/0282951 | A1 | 9/2014 | Ranade |
| 2014/0334322 | A1 | 11/2014 | Shtrom |
| 2015/0070243 | A1 | 3/2015 | Kish |

FOREIGN PATENT DOCUMENTS

| | | | |
|---|---|---|---|
| DE | 10 2006 02635 | | 12/2006 |
| DE | 102006026350 | A1 | 12/2006 |
| EP | 352 787 | | 1/1990 |
| EP | 352787 | A2 | 1/1990 |
| EP | 0 534 612 | | 3/1993 |
| EP | 0 756 381 | | 1/1997 |
| EP | 0756381 | A2 | 1/1997 |
| EP | 0883206 | A2 | 5/1998 |
| EP | 0 883 206 | | 12/1998 |
| EP | 1 152 542 | | 11/2001 |
| EP | 1 152 543 | | 11/2001 |
| EP | 1152543 | A1 | 11/2001 |
| EP | 1 376 920 | | 6/2002 |
| EP | 1 220 461 | | 7/2002 |
| EP | 1 315 311 | | 5/2003 |
| EP | 1 450 521 | | 8/2004 |
| EP | 1 450521 | | 8/2004 |
| EP | 1 608 108 | | 12/2005 |
| EP | 1608108 | | 12/2005 |
| EP | 1 909 358 | | 4/2008 |
| EP | 1 287 588 | | 1/2009 |
| GB | 2 426 870 | | 6/2006 |
| GB | 2426870 | A | 6/2006 |
| GB | 2 423 191 | | 8/2006 |
| GB | 2423191 | A | 8/2006 |
| JP | 03038933 | | 2/1991 |
| JP | 2008088633 | | 2/1996 |
| JP | 2008/088633 | | 4/1996 |
| JP | 2001-057560 | | 2/2001 |
| JP | 2002-505835 | | 2/2002 |
| JP | 2001057560 | | 2/2002 |
| JP | 2005-354249 | | 12/2005 |
| JP | 2005354249 | | 12/2005 |
| JP | 2006/060408 | | 3/2006 |
| JP | 2006060408 | | 3/2006 |
| WO | WO 90/04893 | | 5/1990 |
| WO | WO9004893 | | 5/1990 |
| WO | WO 99/55012 | | 10/1999 |
| WO | WO9955012 | A2 | 10/1999 |
| WO | WO 01/13461 | | 2/2001 |
| WO | WO 01/69724 | | 9/2001 |
| WO | WO 02/25967 | | 3/2002 |
| WO | WO02025967 | | 3/2002 |
| WO | WO 03/079484 | | 9/2003 |
| WO | WO03079484 | | 9/2003 |
| WO | WO 03/081718 | | 10/2003 |

(56) References Cited

FOREIGN PATENT DOCUMENTS

| | | |
|---|---|---|
| WO | WO 2004/051798 | 6/2004 |
| WO | WO2004051798 | 6/2004 |

OTHER PUBLICATIONS

U.S. Appl. No. 95/001,078, filed Sep. 4, 2008, Shtrom et al.
U.S. Appl. No. 95/001,079, filed Sep. 4, 2008, Shtrom et al.
Chuang et al., A 2.4 GHz Polarization-diversity Planar Printed Dipole for WLAN and Wireless Communication Applications, Microwave Journal, vol. 45, No. 6, pp. 50-62 (Jun. 2002).
Frederick et al., Smart Antennas Based on Spatial Multiplexing of Local Elements (SMILE) for Mutual Coupling Reduction, IEEE Transaction of Antennas and propogation, vol. 52., No. 1, pp. 106-114 (Jan. 2004).
W.E. Doherty, Jr. et al., "The Pin Diode Circuit Designer's Handbook," 1998.
English Translation of PCT Pub. No. WO2004/051798 (as fioled U.S. Appl. No. 10/536,547).
Behdad et al., "Slot Antenna Miniaturization Using Distributed Inductive Loading," Antenna and Propogation Society International Symposium, 2003 IEEE, vol. 1, pp. 308-311 (Jun. 2003).
Press Release, Netgear RangeMax™ Wireless Networking Solutions Incorporate Smart MIMO Technology to Eliminate Wireless Dead Spots and Take Consumers Farther, Ruckus Wireless Inc.
"Authorization of Spread Spectrum Systems Under Parts 15 and 90 of the FCC Rules and Regulations," Rules and Regulations Federal Communications Commission, 47 CFR Part 2, 15, and 90.
"Authorization of spread spectrum and other wideband emissions not presently provided for in the FCC Rules and Regulations," Before the Federal Communications Commission, FCC 81-289, 87 F.C.C. 2d 876, Gen Docket No. 81-413, Jun. 30, 1981.
RL Miller, 4.3 Project X—A True Secrecy System for Speech, Engineering and Science in the Bell System, A History of Engineering and Science in the Bell System National Service in War and Peace (1925-1975), pp. 296-317, 1978, Bell Telephone Laboratories, Inc.
Chang, Robert W. et al. Synthesis of Band-Limited Orthogonal Signals for Multichannel Data Transmission, The Bell System Technical Journal, Dec. 1966, pp. 1775-1796.
Cimini, Leonard J. Jr., "Analysis and Simulation of a Digital Mobile Channel Using Orthogonal Frequency Division Multiplexing," IEEE Transactions on Communications, vol. Com-33, No. 7 Jul. 1985, pp. 665-675.
Saltzberg, Burton R., "Performance of an Efficient Parallel Data Transmission System." IEEE Transactions on Communication Technology, vol. Com-15, No. 6 Dec. 1967, pp. 805-811.
Weinstein, S.B., et al., "Data Transmission by Frequency-Division Multiplexing Using the Discrete Fourier Transform," IEEE Transactions on Communications, vol. Col-19, No. 5, Oct. 1971, pp. 628-634.
Moose, Paul H., "Differential Modulation and Demodulation of Multi-Frequency Digital Communications Signals," 1990 IEEE, CH2831-6/90/0000-0273.
Casas, Eduardo F., "OFDM for Data Communication Over Mobile Radio FM Channels-Part1: Analysis and Experimental Results." IEEE Transactions on Communications, vol. 39, No. 5, May 1991, pp. 783-793.
Casas, Eduardo F., "OFDM for Data Communication over Mobile Radio FM Channels; Part II: Performance Improvement." Department of Electrical Engineering, University of British Columbia.
Chang, Robert W., et al., "A Theoretical Study of Performance of an Orthogonal Multiplexing Data Transmission Scheme." IEEE Transactions on Communication Technology, vol. Com-16, No. 4, Aug. 1968, pp. 529-540.
Gledhill, J.J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.
Alard, M., et al., "Principles of Modulationand Channel Coding for Digital Broadcasting for Mobile Receivers," 8301 EBU Review Technical, Aug. 1987, No. 224, Brussels, Belgium.
Berenguer, Inaki, et al., "Adaptive MIMO Antenna Selection" Nov. 2003.
Guar, Sudhanshu, et al., "Transmit/ Receive Antenna Selection for MIMO Systems to Improve Error Performance of Linear Receivers," School of ECE, Georgia Institute of Technology, Apr. 4, 2005.
Sadek, Mirett et al., "Active Antenna Selection in Multiuser MIMO Communications," IEEE Transactions on Signal Processing, vol. 55, No. 4, Apr. 2007, pp. 1498-1510.
Molisch, Andreas F., et al., "MIMO Systems with Antenna Selection-and Overview," Draft, Dec. 31, 2003.
Tang, Ken, et al., "MAC Layer Broadcast Support in 802.11 Wireless Networks" Computer Science Department, University of California, Los Angeles, 2000 IEEE, pp. 544-548.
Tang, Ken, et al., "MAC Reliable Broadcast in Ad Hoc Networks," Computer Science Department, University of California, Los Angeles, 2001 IEEE, Jul. 1998, pp. 1008-1013.
Park, Vincent D., et al., "A Performance Comparison of the Termprally-Ordered Routing Algorithm and Ideal Link-State Routing," IEEE, Jul. 1998, pp. 592-598.
Akyildiz, Ian F., et al. "A Virtual Topology Based Routing Protocol for Multihop Dynamic Wireless Networks," Broadband and Wireless Networking Lab, School of Electrical and Computer Engineering, Georgia Institute of Technology.
Microsoft Corporation, "IEEE 802.11 Networks and Windows Xp," Windows Harware Developer Central, Dec. 4, 2001.
Dunkels, Adam et al., "Connecting Wireless Sensornets with TCP/IP Networks," Proc. of the 2nd Int'l Conf. on Wired Networks, Frankfurt, Feb. 2004.
Hirayama, Koji et al., "Next Generation Mobile-Access IP Network" hitachi Review vol. 49, No. 4, 2000.
Calhoun, Pat et al., "802.11r strengthens wireless voice," Technology Update, Network World, Aug. 22, 2005.
Alimian, Areg et al., "Analysis of Roaming Techniques," doc.:IEEE 802.11-04/0377r1, Submission, Mar. 2004.
Information Soceity Techonologies Ultrawaves, "System Concept / Architecture Design and Communcation Stack Requirement Document," Feb. 23, 2004.
Golmie, Nada, "Coexistence in Wireless Networks: Challenges and System-level solutions in the uinlicensed bands," Cambridge University Press, 2006.
Chang, Nicholas B. et al., "Optimal Channel Probing and Transmission Scheduling for Opportunistics Spectrum Access" Sep. 2007.
Tsunekawa, "Diversity Antennas for Portable Telephones," 39th IEEE Vehicular Technology Conference, pp. 50-56, vol. 1, Gateway to New Concepts in Vehicular Technology, May 1-3, 1989, San Francisco, CA.
Supplementary European Search Report dated Jul. 21, 2009 in European patent application No. 05 776697.4.-1248.
Supplementary European Search Report for foreign application No. EP07755519 dated Mar. 11, 2009.
Request for Inter Partes reexamination for U.S. Pat. No. 7,358,912, filed by Rayspan Corporation and Netgear, Inc. on Sep. 4, 2008.
Response to Mar. 19, 2009 Office Action issued in Reexamination for U.S. Pat. No. 7,358,912 (No. 95/001079), filed May 19, 2009.
Orinco, AP-2000 5GHz Kit, "Access Point Family," Proxim Wireless Corporation.
Ando et al., Study of Dual-Polarized Omni-Directional Antennas for 5.2 GHz-Band 2×2 MIMO-OFDM Systems, Antennas and Propagation Society International Symposium, IEEE, pp. 1740-1743 vol. 2, 2004.
Bedell, "Wireless Crash Course," p. 84, The McGraw-Hill Companies, Inc., USA, 2005.
Right of Appeal Notice for U.S. Pat. No. 7,193,562 (Control No. 95/001078) mailed on Jul. 10, 2009.
Ruckus Wireless, Inc. vs. Netgear, Inc; Defendant Netgear, Inc. Invalidity Contentions.
Abramov 2003—P.R. 3-3 © Chart for U.S. Pat. No. 7,525,486 and U.S. Pat. No. 7,193,562.

(56) References Cited

OTHER PUBLICATIONS

Abramov 273—P.R. 3-3 © Chart for U.S. Pat. No. 7,525,486 and U.S. Pat. No. 7,193,562.
Abramov 296—P.R. 3-3 © Chart for U.S. Pat. No. 7,525,486 and U.S. Pat. No. 7,193,562.
Airgain 2004—P.R. 3-3 © Chart for U.S. Pat. No. 7,525,486 and U.S. Pat. No. 7,193,562.
Bancroft 863—P.R. 3-3 © Chart for U.S. Pat. No. 7,525,486 and U.S. Pat. No. 7,193,562.
Barabash 059—P.R. 3-3 © Chart for U.S. Pat. No. 7,525,486 and U.S. Pat. No. 7,193,562.
Cetiner 2003—P.R. 3-3 © Chart for U.S. Pat. No. 7,525,486 and U.S. Pat. No. 7,193,562.
Chuang 2003—P.R. 3-3 © Chart for U.S. Pat. No. 7,525,486 and U.S. Pat. No. 7,193,562.
Evans 864—P.R. 3-3 © Chart for U.S. Pat. No. 7,525,486.
Johnson 404—P.R. 3-3 © Chart for U.S. Pat. No. 7,525,486 and U.S. Pat. No. 7,193,562.
Kalis 2000—P.R. 3-3 © Chart for U.S. Pat. No. 7,525,486 and U.S. Pat. No. 7,193,562.
Kalis 2002—P.R. 3-3 © Chart for U.S. Pat. No. 7,525,486.
Kaluzni 717—P.R. 3-3 © Chart for U.S. Pat. No. 7,525,486 and U.S. Pat. No. 7,193,562.
Kim 693—P.R. 3-3 © Chart for U.S. Pat. No. 7,525,486 and U.S. Pat. No. 7,193,562.
Lin 836—P.R. 3-3 © Chart for U.S. Pat. No. 7,525,486 and U.S. Pat. No. 7,193,562.
Nakao 762—P.R. 3-3 © Chart for U.S. Pat. No. 7,525,486.
Okada 201—P.R. 3-3 © Chart for U.S. Pat. No. 7,525,486 and U.S. Pat. No. 7,193,562.
Palmer 773—P.R. 3-3 © Chart for U.S. Pat. No. 7,525,486 and U.S. Pat. No. 7,193,562.
Paun 749—P.R. 3-3 © Chart for U.S. Pat. No. 7,525,486 and U.S. Pat. No. 7,193,562.
Qian 2000—P.R. 3-3 © Chart for U.S. Pat. No. 7,525,486 and U.S. Pat. No. 7,193,562.
Shehab 2003—P.R. 3-3 © Chart for U.S. Pat. No. 7,525,486 and U.S. Pat. No. 7,193,562.
Shirosaka 907—P.R. 3-3 © Chart for U.S. Pat. No. 7,525,486 and U.S. Pat. No. 7,193,562.
Shtrom 198 & 280—P.R. 3-3 © Chart for U.S. Pat. No. 7,525,486 and U.S. Pat. No. 7,193,562.
Sievenpiper 254—P.R. 3-3 © Chart for U.S. Pat. No. 7,525,486 and U.S. Pat. No. 7,193,562.
Simons 1994—P.R. 3-3 © Chart for U.S. Pat. No. 7,525,486 and U.S. Pat. No. 7,193,562.
Sward 643—P.R. 3-3 © Chart for U.S. Pat. No. 7,525,486 and U.S. Pat. No. 7,193,562.
Vaughan 1995—P.R. 3-3 © Chart for U.S. Pat. No. 7,525,486 and U.S. Pat. No. 7,193,562.
Wang 703—P.R. 3-3 © Chart for U.S. Pat. No. 7,525,486 and U.S. Pat. No. 7,193,562.
Alard, M., et al., "Principles of Modulation and Channel Coding for Digital Broadcasting for Mobile Receivers," 8301 EBU Review Technical, Aug. 1987, No. 224, Brussels, Belgium.
Ando et al., "Study of Dual-Polarized Omni-Directional Antennas for 5.2 GHz-Band 2×2 MIMO-OFFDM Systems," Antennas and Propogation Society International Symposium, 2004, IEEE, pp. 1740-1743 vol. 2.
Areg Alimian et al., "Analysis of Roaming Techniques," doc.:IEEE 802.11-04/0377r1, Submission, Mar. 2004.
"Authorization of Spread Spectrum Systems Under Parts 15 and 90 of the FCC Rules and Regulations," Rules and Regulations Federal Communications Commission, 47 CFR Part 2, 15, and 90, Jun. 18, 1985.
"Authorization of spread spectrum and other wideband emissions not presently provided for in the FCC Rules and Regulations," Before the Federal Communications Commission, FCC 81-289, 87 F.C.C.2d 876, Gen Docket No. 81-413, Jun. 30, 1981.
Bedell, Paul, "Wireless Crash Course," 2005, p. 84, The McGraw-Hill Companies, Inc., USA.
Behdad et al., Slot Antenna Miniaturization Using Distributed Inductive Loading, Antenna and Propagation Society International Symposium, 2003 IEEE, vol. 1, pp. 308-311 (Jun. 2003).
Berenguer, Inaki, et al., "Adaptive MIMO Antenna Selection," Nov. 2003.
Casas, Eduardo F., et al., "OFDM for Data Communication Over Mobile Radio FM Channels—Part I: Analysis and Experimental Results," IEEE Transactions on Communications, vol. 39, No. 5, May 1991, pp. 783-793.
Casas, Eduardo F., et al., "OFDM for Data Communication over Mobile Radio FM Channels; Part II: Performance Improvement," Department of Electrical Engineering, University of British Columbia.
Chang, Nicholas B. et al., "Optimal Channel Probing and Transmission Scheduling for Opportunistics Spectrum Access," Sep. 2007.
Chang, Robert W., et al., "A Theoretical Study of Performance of an Orthogonal Multiplexing Data Transmission Scheme," IEEE Transactions on Communication Technology, vol. Com-16, No. 4, Aug. 1968, pp. 529-540.
Chang, Robert W., "Synthesis of Band-Limited Orthogonal Signals for Multichannel Data Transmission," The Bell System Technical Journal, Dec. 1966, pp. 1775-1796.C.
Chuang et al., A 2.4 GHz Polarization-diversity Planar Printed Dipole Antenna for WLAN and Wireless Communication Applications, Microwave Journal, vol. 45, No. 6, pp. 50-62 (Jun. 2002).
Cimini, Jr., Leonard J, "Analysis and Simulation of a Digital Mobile Channel Using Orthogonal Frequency Division Multiplexing," IEEE Transactions on Communications, vol. Com-33, No. 7, Jul. 1985, pp. 665-675.
Cisco Systems, "Cisco Aironet Access Point Software Configuration Guide: Configuring Filters and Quality of Service," Aug. 2003.
Dell Inc., "How Much Broadcast and Multicast Traffic Should I Allow in My Network," PowerConnect Application Note #5, Nov. 2003.
Dutta, Ashutosh et al., "MarconiNet Supporting Streaming Media Over Localized Wireless Multicast," Proc. of the 2d Int'l Workshop on Mobile Commerce, 2002.
Dunkels, Adam et al., "Making TCP/IP Viable for Wireless Sensor Networks," Proc. of the 1st Euro. Workshop on Wireless Sensor Networks, Berlin, Jan. 2004.
Dunkels, Adam et al., "Connecting Wireless Sensornets with TCP/IP Networks," Proc. of the 2d Int'l Conf. on Wired Networks, Frankfurt, Feb. 2004.
English Translation of PCT Pub. No. WO2004/051798 (as filed US National Stage U.S. Appl. No. 10/536,547).
Festag, Andreas, "What is MOMBASA?" Telecommunication Networks Group (TKN), Technical University of Berlin, Mar. 7, 2002.
Frederick et al., Smart Antennas Based on Spatial Multiplexing of Local Elements (SMILE) for Mutual Coupling Reduction, IEEE Transactions of Antennas and Propogation, vol. 52., No. 1, pp. 106-114 (Jan. 2004).
Gaur, Sudhanshu, et al., "Transmit/Receive Antenna Selection for MIMO Systems to Improve Error Performance of Linear Receivers," School of ECE, Georgia Institute of Technology, Apr. 4, 2005.
Gledhill, J. J., et al., "The Transmission of Digital Television in the UHF Band Using Orthogonal Frequency Division Multiplexing," Sixth International Conference on Digital Processing of Signals in Communications, Sep. 2-6, 1991, pp. 175-180.
Golmie, Nada, "Coexistence in Wireless Networks: Challenges and System-Level Solutions in the Unlicensed Bands," Cambridge University Press, 2006.
Hewlett Packard, "HP ProCurve Networking: Enterprise Wireless LAN Networking and Mobility Solutions," 2003.
Hirayama, Koji et al., "Next-Generation Mobile-Access IP Network," Hitachi Review vol. 49, No. 4, 2000.
Ian F. Akyildiz, et al., "A Virtual Topology Based Routing Protocol for Multihop Dynamic Wireless Networks," Broadband and Wireless Networking Lab, School of Electrical and Computer Engineering, Georgia Institute of Technology.

(56) References Cited

OTHER PUBLICATIONS

Information Society Technologies Ultrawaves, "System Concept / Architecture Design and Communication Stack Requirement Document," Feb. 23, 2004.
Ken Tang, et al., "MAC Layer Broadcast Support in 802.11 Wireless Networks," Computer Science Department, University of California, Los Angeles, 2000 IEEE, pp. 544-548.
Ken Tang, et al., "MAC Reliable Broadcast in Ad Hoc Networks," Computer Science Department, University of California, Los Angeles, 2001 IEEE, pp. 1008-1013.
Mawa, Rakesh, "Power Control in 3G Systems," Hughes Systique Corporation, Jun. 28, 2006.
Microsoft Corporation, "IEEE 802.11 Networks and Windows XP," Windows Hardware Developer Central, Dec. 4, 2001.
Molisch, Andreas F., et al., "MIMO Systems with Antenna Selection—an Overview," Draft, Dec. 31, 2003.
Moose, Paul H., "Differential Modulation and Demodulation of Multi-Frequency Digital Communications Signals," 1990 IEEE,CH2831-6/90/0000-0273.
Orinoco AP-2000 5GHz Kit, "Access Point Family," Proxim Wireless Corporation.
Pat Calhoun et al., "802.11r strengthens wireless voice," Technology Update, Network World, Aug. 22, 2005, http://www.networkworld.com/news/tech/2005/082208techupdate.html.
Press Release, Netgear RangeMax(TM) Wireless Networking Solutions Incorporate Smart MIMO Technology to Eliminate Wireless Dead Spots and Take Consumers Farther, Ruckus Wireles Inc. (Mar. 7, 2005), available at http://ruckuswireless.com/press/releases/20050307.php.
RL Miller, "4.3 Project X—A True Secrecy System for Speech," Engineering and Science in the Bell System, A History of Engineering and Science in the Bell System National Service in War and Peace (1925-1975), pp. 296-317, 1978, Bell Telephone Laboratories, Inc.
Sadek, Mirette, et al., "Active Antenna Selection in Multiuser MIMO Communications," IEEE Transactions on Signal Processing, vol. 55, No. 4, Apr. 2007, pp. 1498-1510.
Saltzberg, Burton R., "Performance of an Efficient Parallel Data Transmission System," IEEE Transactions on Communication Technology, vol. Com-15, No. 6, Dec. 1967, pp. 805-811.
Steger, Christopher et al., "Performance of IEEE 802.11b Wireless LAN in an Emulated Mobile Channel," 2003.
Toskala, Antti, "Enhancement of Broadcast and Introduction of Multicast Capabilities in RAN," Nokia Networks, Palm Springs, California, Mar. 13-16, 2001.
Tsunekawa, Kouichi, "Diversity Antennas for Portable Telephones," 39th IEEE Vehicular Technology Conference, pp. 50-56, vol. I, Gateway to New Concepts in Vehicular Technology, May 1-3, 1989, San Francisco, CA.
Varnes et al., A Switched Radial Divider for an L-Band Mobile Satellite Antenna, European Microwave Conference (Oct. 1995), pp. 1037-1041.
Vincent D. Park, et al., "A Performance Comparison of the Temporally-Ordered Routing Algorithm and Ideal Link-State Routing," IEEE, Jul. 1998, pp. 592-598.
W.E. Doherty, Jr. et al., The Pin Diode Circuit Designer's Handbook (1998).
Weinstein, S. B., et al., "Data Transmission by Frequency-Division Multiplexing Using the Discrete Fourier Transform," IEEE Transactions on Communication Technology, vol. Com-19, No. 5, Oct. 1971, pp. 628-634.
Wennstrom, Mattias et al., "Transmit Antenna Diversity in Ricean Fading MIMO Channels with Co-Channel Interference," 2001.
Petition Decision Denying Request to Order Additional Claims for U.S. Pat. No. 7,193,562 (Control No. 95/001078) mailed on Jul. 10, 2009.
Right of Appeal Notice for U.S. Pat. No. 7,193,562 (Control No. 95/001078) mailed on Jul. 2009.
European Examination Report for EP Application No. 05776697.4 dated Jan. 21, 2011.
European Second Examination Report for EP Application No. 07775498.4 dated Mar. 12, 2013.
European Third Examination Report for EP Application No. 07775498.4 dated Oct. 17, 2011.
European First Examination Report for EP Application No. 09014989.9 dated May 7, 2012.
Supplementary European Search Report for EP Application No. EP05776697.4 dated Jul. 10, 2009.
Supplementary European Search Report for EP Application No. EP07755519 dated Mar. 11, 2009.
PCT Application No. PCT/US2005/27023, International Search Report and Written Opinion dated Dec. 23, 2005.
PCT Application No. PCT/US2006/49211, International Search Report and Written Opinion dated Aug. 29, 2008.
PCT Application No. PCT/US2007/09276, International Search Report and Written Opinion dated Aug. 11, 2008.
Chinese Application No. 200680048001.7, Office Action dated Jun. 20, 2012.
Chinese Application No. 200780020943.9, Office Action dated Feb. 7, 2013.
Chinese Application No. 200780020943.9, Office Action dated Aug. 29, 2012.
Chinese Application No. 200780020943.9, Office Action dated Dec. 19, 2011.
Chinese Application No. 200910258884.X, Office Action dated Aug. 3, 2012.
Taiwan Application No. 094127953, Office Action dated Mar. 20, 2012.
Taiwan Application No. 096114265, Office Action dated Jun. 20, 2011.
U.S. Appl. No. 11/010,076, Office Action dated Oct. 31, 2006.
U.S. Appl. No. 11/010,076, Final Office Action dated Aug. 8, 2006.
U.S. Appl. No. 11/010,076, Office Action dated Dec. 23, 2006.
U.S. Appl. No. 11/022,080, Office Action dated Jul. 21, 2006.
U.S. Appl. No. 11/041,145, Final Office Action dated Jan. 29, 2007.
U.S. Appl. No. 11/041,145, Office Action dated Jul. 21, 2006.
U.S. Appl. No. 11/265,751, Office Action dated Mar. 18, 2008.
U.S. Appl. No. 11/413,461, Office Action dated Jun. 7, 2007.
U.S. Appl. No. 11/714,707, Final Office Action dated May 30, 2008.
U.S. Appl. No. 11/714,707, Office Action dated Oct. 15, 2007.
U.S. Appl. No. 11/924,082, Office Action dated Aug. 29, 2008.
U.S. Appl. No. 12/082,090, Office Action dated Jan. 18, 2011.
U.S. Appl. No. 12/404,124, Final Office Action dated Feb. 7, 2012.
U.S. Appl. No. 12/404,124, Office Action dated Sep. 19, 2011.
U.S. Appl. No. 12/953,324, Office Action dated Mar. 24, 2011.
U.S. Appl. No. 13/280,278, Office Action dated Mar. 25, 2013.
U.S. Appl. No. 13/280,278, Final Office Action mailed Aug. 22, 2012.
U.S. Appl. No. 13/280,278, Office Action dated Feb. 21, 2012.
U.S. Appl. No. 13/305,609, Final Office Action dated Jul. 3, 2012.
U.S. Appl. No. 13/305,609, Office Action dated Dec. 20, 2011.
U.S. Appl. No. 13/485,012, Final Office Action dated Mar. 3, 2013.
U.S. Appl. No. 13/485,012, Office Action dated Oct. 25, 2012.
U.S. Appl. No. 13/862,834, Office Action dated Apr. 27, 2015.
U.S. Appl. No. 13/396,482, Final Office Action dated Jan. 22, 2015.
U.S. Appl. No. 13/396,484, Office Action dated Jan. 21, 2015.
U.S. Appl. No. 13/862,834, Final Office Action dated Sep. 22, 2015.
U.S. Appl. No. 13/396,482, Office Action dated Aug. 20, 2015.
U.S. Appl. No. 13/396,484, Final Office Action dated Aug. 20, 2015.

* cited by examiner

ANTENNA WITH SELECTABLE ELEMENTS FOR USE IN WIRELESS COMMUNICATIONS

CROSS-REFERENCE TO RELATED APPLICATIONS

This application is a divisional and claims the priority benefit of U.S. patent application Ser. No. 11/877,465 filed Oct. 23, 2007 and entitled "Antenna with Selectable Elements for Use in Wireless Communications," which is a continuation and claims the priority benefit of U.S. patent application Ser. No. 11/010,076 filed Dec. 9, 2004 and entitled "System and Method for an Omnidirectional Planar Antenna Apparatus with Selectable Elements," which is now U.S. Pat. No. 7,292,198, which claims the priority benefit of U.S. Provisional Application No. 60/602,711 entitled "Planar Antenna Apparatus for Isotropic Coverage and QoS Optimization in Wireless Networks," filed Aug. 18, 2004, and U.S. Provisional Application No. 60/603,157 entitled "Software for Controlling a Planar Antenna Apparatus for Isotropic Coverage and QoS Optimization in Wireless Networks," filed Aug. 18, 2004. The disclosure of each of the aforementioned applications is incorporated by reference.

BACKGROUND OF INVENTION

Field of the Invention

The present invention relates generally to wireless communications networks, and more particularly to a system and method for an omnidirectional planar antenna apparatus with selectable elements.

Description of the Prior Art

In communications systems, there is an ever-increasing demand for higher data throughput, and a corresponding drive to reduce interference that can disrupt data communications. For example, in an IEEE 802.11 network, an access point (i.e., base station) communicates data with one or more remote receiving nodes (e.g., a network interface card) over a wireless link. The wireless link may be susceptible to interference from other access points, other radio transmitting devices, changes or disturbances in the wireless link environment between the access point and the remote receiving node, and so on. The interference may be such to degrade the wireless link, for example by forcing communication at a lower data rate, or may be sufficiently strong to completely disrupt the wireless link.

One solution for reducing interference in the wireless link between the access point and the remote receiving node is to provide several omnidirectional antennas for the access point, in a "diversity" scheme. For example, a common configuration for the access point comprises a data source coupled via a switching network to two or more physically separated omnidirectional antennas. The access point may select one of the omnidirectional antennas by which to maintain the wireless link. Because of the separation between the omnidirectional antennas, each antenna experiences a different signal environment, and each antenna contributes a different interference level to the wireless link. The switching network couples the data source to whichever of the omnidirectional antennas experiences the least interference in the wireless link.

However, one problem with using two or more omnidirectional antennas for the access point is that typical omnidirectional antennas are vertically polarized. Vertically polarized radio frequency (RF) energy does not travel as efficiently as horizontally polarized RF energy inside a typical office or dwelling space, additionally, most of the laptop computer wireless cards have horizontally polarized antennas. Typical solutions for creating horizontally polarized RF antennas to date have been expensive to manufacture, or do not provide adequate RF performance to be commercially successful.

A further problem is that the omnidirectional antenna typically comprises an upright wand attached to a housing of the access point. The wand typically comprises a hollow metallic rod exposed outside of the housing, and may be subject to breakage or damage. Another problem is that each omnidirectional antenna comprises a separate unit of manufacture with respect to the access point, thus requiring extra manufacturing steps to include the omnidirectional antennas in the access point.

A still further problem with the two or more omnidirectional antennas is that because the physically separated antennas may still be relatively close to each other, each of the several antennas may experience similar levels of interference and only a relatively small reduction in interference may be gained by switching from one omnidirectional antenna to another omnidirectional antenna.

Another solution to reduce interference involves beam steering with an electronically controlled phased array antenna. However, the phased array antenna can be extremely expensive to manufacture. Further, the phased array antenna can require many phase tuning elements that may drift or otherwise become maladjusted.

SUMMARY OF INVENTION

In a first claimed embodiment, a network peripheral device is disclosed. The device includes a plurality of antennas and at least a single wireless module that is operable with the plurality of antennas. The single wireless module includes a single baseband operable with the plurality of antennas, an antenna selector control module operable with the baseband, and a processor. The device further includes a plurality of electronically controllable visual indicators and circuitry that activates and deactivates selected indicators from the plurality of indicators. The activation and deactivation corresponds to selection and deselection of respective antennas from among the plurality of antennas by the single wireless module as the single wireless module continues to operate.

BRIEF DESCRIPTION OF DRAWINGS

The present invention will now be described with reference to drawings that represent a preferred embodiment of the invention. In the drawings, like components have the same reference numerals. The illustrated embodiment is intended to illustrate, but not to limit the invention. The drawings include the following figures.

DETAILED DESCRIPTION

A system for a wireless (i.e., radio frequency or RF) link to a remote receiving device includes a communication device for generating an RF signal and a planar antenna apparatus for transmitting and/or receiving the RF signal. The planar antenna apparatus includes selectable antenna elements. Each of the antenna elements provides gain (with respect to isotropic) and a directional radiation pattern substantially in the plane of the antenna elements. Each antenna element may be electrically selected (e.g., switched on or off) so that the planar antenna apparatus may form a configurable radiation pattern. If all elements are switched on, the planar antenna apparatus forms an omnidirectional radiation pattern. In some embodiments, if two or more of the elements is switched on, the planar antenna apparatus may form a substantially omnidirectional radiation pattern.

Advantageously, the system may select a particular configuration of selected antenna elements that minimizes interference over the wireless link to the remote receiving device. If the wireless link experiences interference, for example due to other radio transmitting devices, or changes or disturbances in the wireless link between the system and the remote receiving device, the system may select a different configuration of selected antenna elements to change the resulting radiation pattern and minimize the interference. The system may select a configuration of selected antenna elements corresponding to a maximum gain between the system and the remote receiving device. Alternatively, the system may select a configuration of selected antenna elements corresponding to less than maximal gain, but corresponding to reduced interference in the wireless link.

As described further herein, the planar antenna apparatus radiates the directional radiation pattern substantially in the plane of the antenna elements. When mounted horizontally, the RF signal transmission is horizontally polarized, so that RF signal transmission indoors is enhanced as compared to a vertically polarized antenna. The planar antenna apparatus is easily manufactured from common planar substrates such as an FR4 printed circuit board (PCB). Further, the planar antenna apparatus may be integrated into or conformally mounted to a housing of the system, to minimize cost and to provide support for the planar antenna apparatus.

Figure 1:
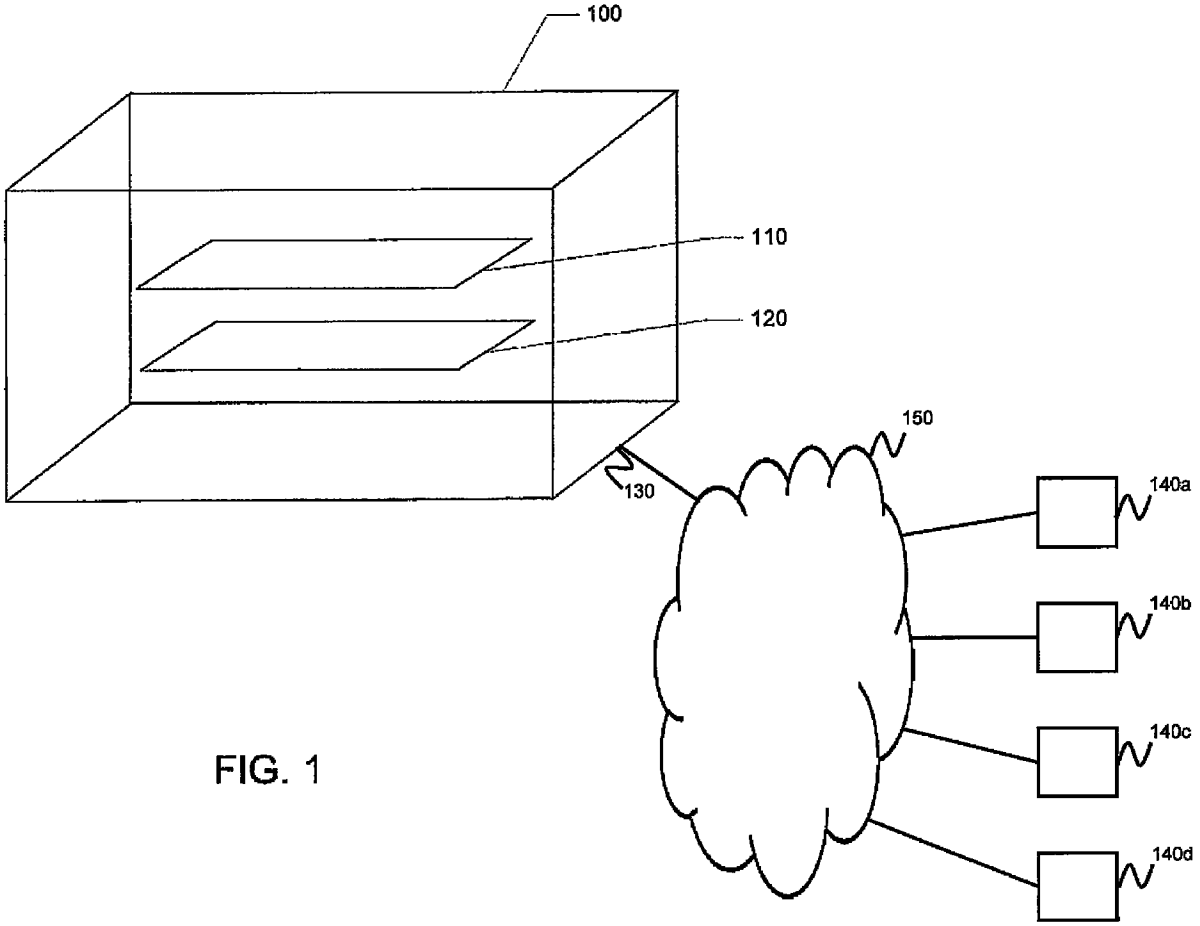
FIG. 1 illustrates a system comprising an omnidirectional planar antenna apparatus with selectable elements, in one embodiment in accordance with the present invention.

FIG. 1 illustrates a system 100 comprising an omnidirectional planar antenna apparatus with selectable elements, in one embodiment in accordance with the present invention. The system 100 may comprise, for example without limitation, a transmitter and/or a receiver, such as an 802.11 access point, an 802.11 receiver, a set-top box, a laptop computer, a television, a PCMCIA card, a remote control, and a remote terminal such as a handheld gaming device. In some exemplary embodiments, the system 100 comprises an access point 130 for communicating to one or more remote receiving nodes 140*a*-140*d* over a wireless link 150, for example in an 802.11 wireless network. Typically, the system 100 may receive data from a router connected to the Internet (not shown), and the system 100 may transmit the data to one or more of the remote receiving nodes 140*a*-140*d*. The system 100 may also from a part of a wireless local area network by enabling communications among several remote receiving nodes. Although the disclosure will focus on a specific embodiment for the system 100, aspects of the invention are applicable to a wide variety of appliances, and are not intended to be limited to the disclosed embodiment. For example, although the system 100 may be described as transmitting to the remote receiving node via the planar antenna apparatus, the system 100 may also receive data from the remote receiving node via the planar antenna apparatus.

The system 100 includes a communication device 120 (e.g., a transceiver) and a planar antenna apparatus 110. The communication device 120 comprises virtually any device for generating and/or receiving an RF signal. The communication device 120 may include, for example, a radio modulator/demodulator for converting data received into the system 100 (e.g., from the router) into the RF signal for transmission to one or more of the remote receiving nodes. In some embodiments, for example, the communication device 120 comprises well-known circuitry for receiving data packets of video from the router and circuitry for converting the data packets into 802.11 compliant RF signals.

As described further herein, the planar antenna apparatus 110 comprises a plurality of individually selectable planar antenna elements. Each of the antenna elements has a directional radiation pattern with gain (as compared to an omnidirectional antenna). Each of the antenna elements also has a polarization substantially in the plane of the planar antenna apparatus 110. The planar antenna apparatus 110 may include an antenna element selecting device configured to selectively couple one or more of the antenna elements to the communication device 120.

Figure 2A:
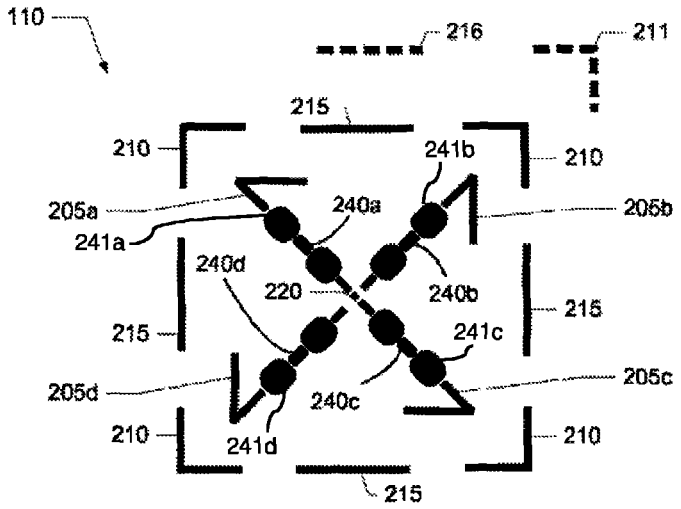
FIG. 2A and FIG. 2B illustrate the planar antenna apparatus of FIG. 1, in one embodiment in accordance with the present invention.
Figure 2B:
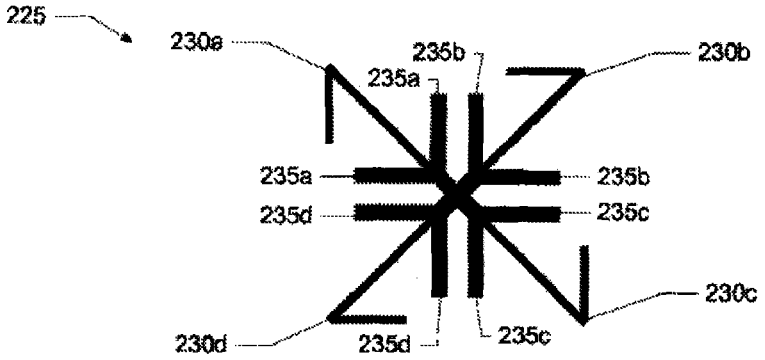

FIG. 2A and FIG. 2B illustrate the planar antenna apparatus 110 of FIG. 1, in one embodiment in accordance with the present invention. The planar antenna apparatus 110 of this embodiment includes a substrate (considered as the plane of FIGS. 2A and 2B) having a first side (e.g., FIG. 2A) and a second side (e.g., FIG. 2B) substantially parallel to the first side. In some embodiments, the substrate comprises a PCB such as FR4, Rogers 4003, or other dielectric material.

On the first side of the substrate, the planar antenna apparatus 110 of FIG. 2A includes a radio frequency feed port 220 and four antenna elements 205*a*-205*d*. As described with respect to FIG. 4, although four antenna elements are depicted, more or fewer antenna elements are contemplated. Although the antenna elements 205*a*-205*d* of FIG. 2A are oriented substantially on diagonals of a square shaped planar antenna so as to minimize the size of the planar antenna apparatus 110, other shapes are contemplated. Further, although the antenna elements 205*a*-205*d* form a radially symmetrical layout about the radio frequency feed port 220, a number of non-symmetrical layouts, rectangular layouts, and layouts symmetrical in only one axis, are contemplated. Furthermore, the antenna elements 205*a*-205*d* need not be of identical dimension, although depicted as such in FIG. 2A.

On the second side of the substrate, as shown in FIG. 2B, the planar antenna apparatus 110 includes a ground component 225. It will be appreciated that a portion (e.g., the portion 230*a*) of the ground component 225 is configured to form an arrow-shaped bent dipole in conjunction with the antenna element 205*a*. The resultant bent dipole provides a directional radiation pattern substantially in the plane of the planar antenna apparatus 110, as described further with respect to FIG. 3.

Figure 2C:
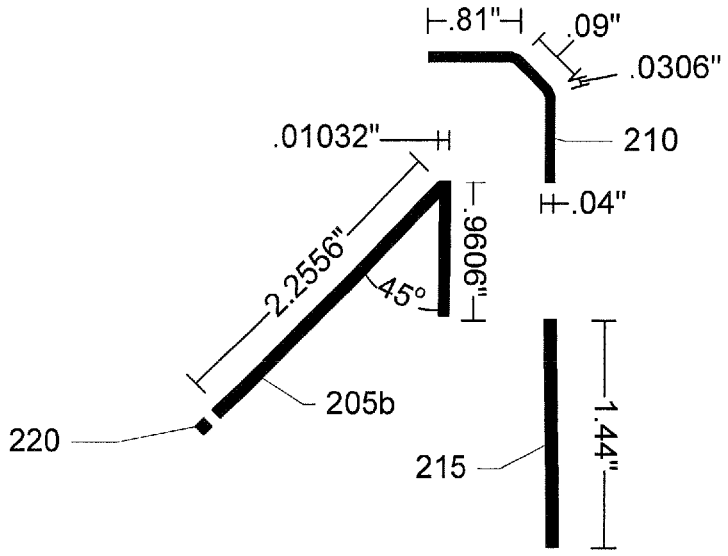
FIGS. 2C and 2D illustrate dimensions for several components of the planar antenna apparatus of FIG. 1, in one embodiment in accordance with the present invention.
Figure 2D:
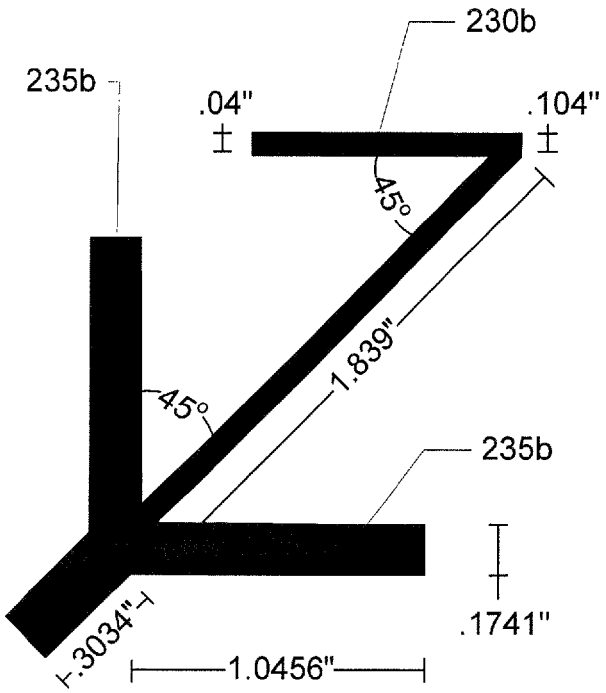

FIGS. 2C and 2D illustrate dimensions for several components of the planar antenna apparatus 110, in one embodiment in accordance with the present invention. It will be appreciated that the dimensions of the individual components of the planar antenna apparatus 110 (e.g., the antenna element 205*a*, the portion 230*a* of the ground component 205) depend upon a desired operating frequency of the planar antenna apparatus 110. The dimensions of the individual components may be established by use of RF simulation software, such as IE3D from Zeland Software of Fremont, Calif. For example, the planar antenna apparatus 110 incorporating the components of dimension according to FIGS. 2C and 2D is designed for operation near 2.4 GHz, based on a substrate PCB of Rogers 4003 material, but it will be appreciated by an antenna designer of ordinary skill that a different substrate having different dielectric properties, such as FR4, may require different dimensions than those shown in FIGS. 2C and 2D.

As shown in FIG. 2, the planar antenna apparatus 110 may optionally include one or more directors 210, one or more gain directors 215, and/or one or more Y-shaped reflectors 235 (e.g., the Y-shaped reflector 235*b* depicted in FIGS. 2B and 2D). The directors 210, the gain directors 215, and the Y-shaped reflectors 235 comprise passive elements that concentrate the directional radiation pattern of the dipoles formed by the antenna elements 205*a*-205*d* in conjunction with the portions 230*a*-230*d*. In one embodiment, providing a director 210 for each antenna element 205*a*-205*d* yields an additional 1-2 dB of gain for each dipole. It will be appreciated that the directors 210 and/or the gain directors 215 may be placed on either side of the substrate. In some embodiments, the portion of the substrate for the directors 210 and/or gain directors 215 is scored so that the directors 210 and/or gain directors 215 may be removed. It will also be appreciated that additional directors (depicted in a position shown by dashed line 211 for the antenna element 205*b*) and/or additional gain directors (depicted in a position shown by a dashed line 216) may be included to further concentrate the directional radiation pattern of one or more of the dipoles. The Y-shaped reflectors 235 will be further described herein.

The radio frequency feed port 220 is configured to receive an RF signal from and/or transmit an RF signal to the communication device 120 of FIG. 1. An antenna element selector (not shown) may be used to couple the radio frequency feed port 220 to one or more of the antenna elements 205*a*-205*d*. The antenna element selector may comprise an RF switch (not shown), such as a PIN diode, a GaAs FET, or virtually any RF switching device, as is well known in the art.

In the embodiment of FIG. 2A, the antenna element selector comprises four PIN diodes 240*a*-240*d*, each PIN diode 240*a*-240*d* connecting one of the antenna elements 205*a*-205*d* to the radio frequency feed port 220. In this embodiment, the PIN diode comprises a single-pole single-throw switch to switch each antenna element either on or off (i.e., couple or decouple each of the antenna elements 205*a*-205*d* to the radio frequency feed port 220). In one embodiment, a series of control signals (not shown) is used to bias each PIN diode 240*a*-240*d*. With the PIN diode forward biased and conducting a DC current, the PIN diode switch is on, and the corresponding antenna element is selected. With the diode reverse biased, the PIN diode switch is off. In this embodiment, the radio frequency feed port 220 and the PIN diodes 240*a*-240*d* of the antenna element selector are on the side of the substrate with the antenna elements 205*a*-205*d*, however, other embodiments separate the radio frequency feed port 220, the antenna element selector, and the antenna elements 205*a*-205*d*. In some embodiments, the antenna element selector comprises one or more single-pole multiple-throw switches. In some embodiments, one or more light emitting diodes (LEDs) 241*a*-241*d* are coupled to the antenna element selector as a visual indicator of which of the antenna elements 205*a*-205*d* is on or off. In one embodiment, a light emitting diode is placed in circuit with the PIN diode so that the light emitting diode is lit when the corresponding antenna element 205 is selected.

In some embodiments, the antenna components (e.g., the antenna elements 205*a*-205*d*, the ground component 225, the directors 210, and the gain directors 215) are formed from RF conductive material. For example, the antenna elements 205*a*-205*d* and the ground component 225 may be formed from metal or other RF conducting foil. Rather than being provided on opposing sides of the substrate as shown in FIGS. 2A and 2B, each antenna element 205*a*-205*d* is coplanar with the ground component 225. In some embodiments, the antenna components may be conformally mounted to the housing of the system 100. In such embodiments, the antenna element selector comprises a separate structure (not shown) from the antenna elements 205*a*-205*d*. The antenna element selector may be mounted on a relatively small PCB, and the PCB may be electrically coupled to the antenna elements 205*a*-205*d*. In some embodiments, the switch PCB is soldered directly to the antenna elements 205*a*-205*d*.

In the embodiment of FIG. 2B, the Y-shaped reflectors 235 (e.g., the reflectors 235*a*) may be included as a portion of the ground component 225 to broaden a frequency response (i.e., bandwidth) of the bent dipole (e.g., the antenna element 205*a* in conjunction with the portion 230*a* of the ground component 225). For example, in some embodiments, the planar antenna apparatus 110 is designed to operate over a frequency range of about 2.4 GHz to 2.4835 GHz, for wireless LAN in accordance with the IEEE 802.11 standard. The reflectors 235*a*-235*d* broaden the frequency response of each dipole to about 300 MHz (12.5% of the center frequency) to 500 MHz (~20% of the center frequency). The combined operational bandwidth of the planar antenna apparatus 110 resulting from coupling more than one of the antenna elements 205*a*-205*d* to the radio frequency feed port 220 is less than the bandwidth resulting from coupling only one of the antenna elements 205*a*-205*d* to the radio frequency feed port 220. For example, with all four antenna elements 205*a*-205*d* selected to result in an omnidirectional radiation pattern, the combined frequency response of the planar antenna apparatus 110 is about 90 MHz. In some embodiments, coupling more than one of the antenna elements 205*a*-205*d* to the radio frequency feed port 220 maintains a match with less than 10 dB return loss over 802.11 wireless LAN frequencies, regardless of the number of antenna elements 205*a*-205*d* that are switched on.

Figure 3A:
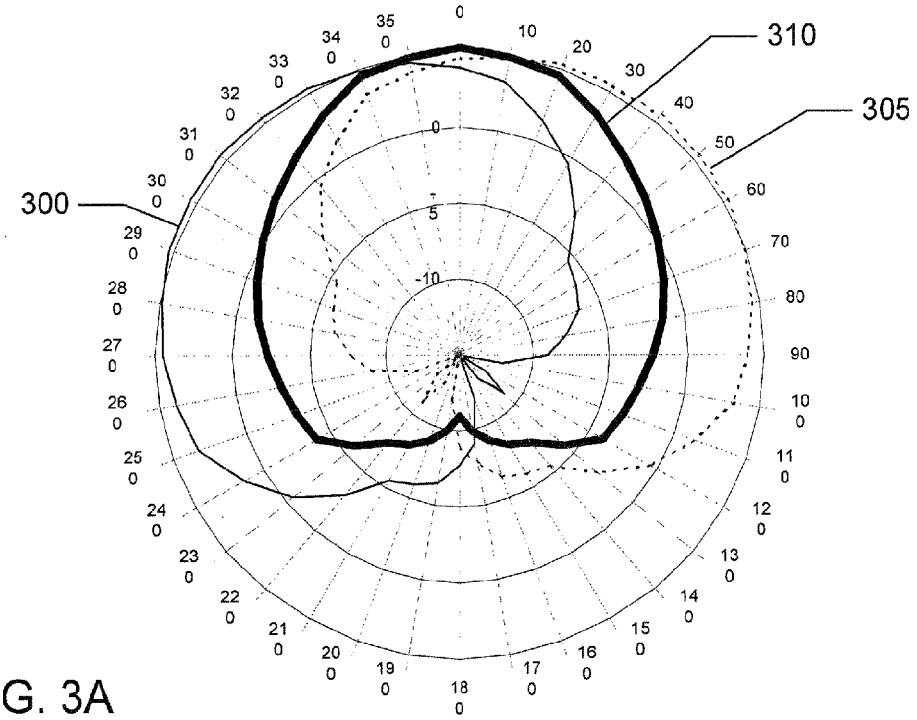
FIG. 3A illustrates various radiation patterns resulting from selecting different antenna elements of the planar antenna apparatus of FIG. 2, in one embodiment in accordance with the present invention.

FIG. 3A illustrates various radiation patterns resulting from selecting different antenna elements of the planar antenna apparatus 110 of FIG. 2, in one embodiment in accordance with the present invention. FIG. 3A depicts the radiation pattern in azimuth (e.g., substantially in the plane of the substrate of FIG. 2). A line 300 displays a generally cardioid directional radiation pattern resulting from selecting a single antenna element (e.g., the antenna element 205*a*). As shown, the antenna element 205*a* alone yields approximately 5 dBi of gain. A dashed line 305 displays a similar directional radiation pattern, offset by approximately 90 degrees, resulting from selecting an adjacent antenna element (e.g., the antenna element 205*b*). A line 310 displays a combined radiation pattern resulting from selecting the two adjacent antenna elements 205*a* and 205*b*. In this embodiment, enabling the two adjacent antenna elements 205*a* and 205*b* results in higher directionality in azimuth as compared to selecting either of the antenna elements 205*a* or 205*b* alone, with approximately 5.6 dBi gain.

The radiation pattern of FIG. 3A in azimuth illustrates how the selectable antenna elements 205*a*-205*d* may be combined to result in various radiation patterns for the planar antenna apparatus 110. As shown, the combined radiation pattern resulting from two or more adjacent antenna elements (e.g., the antenna element 205*a* and the antenna element 205*b*) being coupled to the radio frequency feed port is more directional than the radiation pattern of a single antenna element.

Not shown in FIG. 3A for improved legibility, is that the selectable antenna elements 205*a*-205*d* may be combined to result in a combined radiation pattern that is less directional than the radiation pattern of a single antenna element. For example, selecting all of the antenna elements 205*a*-205*d* results in a substantially omnidirectional radiation pattern that has less directionality than that of a single antenna element. Similarly, selecting two or more antenna elements (e.g., the antenna element 205*a* and the antenna element 205*c* on opposite diagonals of the substrate) may result in a substantially omnidirectional radiation pattern. In this fashion, selecting a subset of the antenna elements 205*a*-205*d*, or substantially all of the antenna elements 205*a*-205*d*, may result in a substantially omnidirectional radiation pattern for the planar antenna apparatus 110.

Although not shown in FIG. 3A, it will be appreciated that additional directors (e.g., the directors 211) and/or gain directors (e.g., the gain directors 216) may further concentrate the directional radiation pattern of one or more of the antenna elements 205*a*-205*d* in azimuth. Conversely, removing or eliminating one or more of the directors 211, the gain directors 216, or the Y-shaped reflectors 235 expands the directional radiation pattern of one or more of the antenna elements 205*a*-205*d* in azimuth.

FIG. 3A also shows how the planar antenna apparatus 110 may be advantageously configured, for example, to reduce interference in the wireless link between the system 100 of FIG. 1 and a remote receiving node. For example, if the remote receiving node is situated at zero degrees in azimuth relative to the system 100 (at the center of FIG. 3A), the antenna element 205*a* corresponding to the line 300 yields approximately the same gain in the direction of the remote receiving node as the antenna element 205*b* corresponding to the line 305. However, as can be seen by comparing the line 300 and the line 305, if an interferer is situated at twenty degrees of azimuth relative to the system 100, selecting the antenna element 205*a* yields approximately a 4 dB signal strength reduction for the interferer as opposed to selecting the antenna element 205*b*. Advantageously, depending on the signal environment around the system 100, the planar antenna apparatus 110 may be configured (e.g., by switching one or more of the antenna elements 205*a*-205*d* on or off) to reduce interference in the wireless link between the system 100 and one or more remote receiving nodes.

Figure 3B:
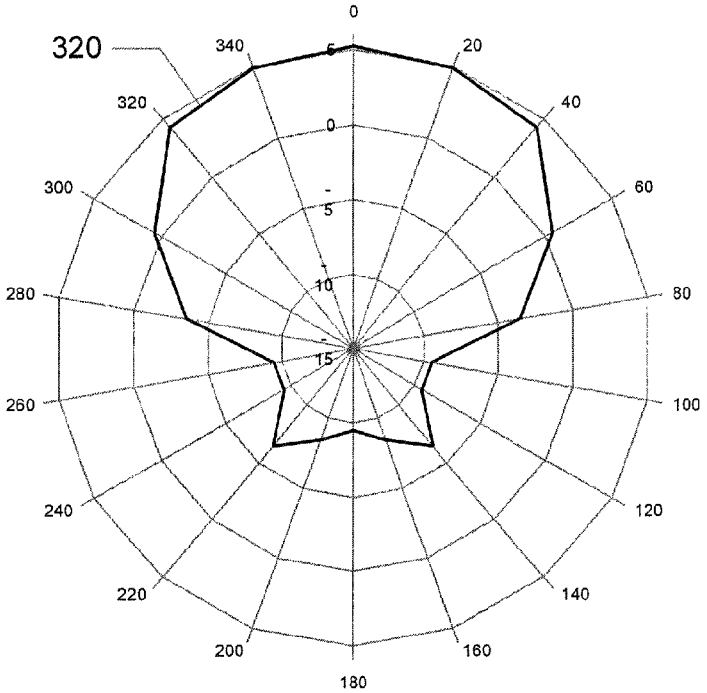
FIG. 3B illustrates an elevation radiation pattern for the planar antenna apparatus of FIG. 2, in one embodiment in accordance with the present invention.

FIG. 3B illustrates an elevation radiation pattern for the planar antenna apparatus 110 of FIG. 2. In the figure, the plane of the planar antenna apparatus 110 corresponds to a line from 0 to 180 degrees in the figure. Although not shown, it will be appreciated that additional directors (e.g., the directors 211) and/or gain directors (e.g., the gain directors 216) may advantageously further concentrate the radiation pattern of one or more of the antenna elements 205*a*-205*d* in elevation. For example, in some embodiments, the system 110 may be located on a floor of a building to establish a wireless local area network with one or more remote receiving nodes on the same floor. Including the additional directors 211 and/or gain directors 216 in the planar antenna apparatus 110 further concentrates the wireless link to substantially the same floor, and minimizes interference from RF sources on other floors of the building.

Figure 4A:
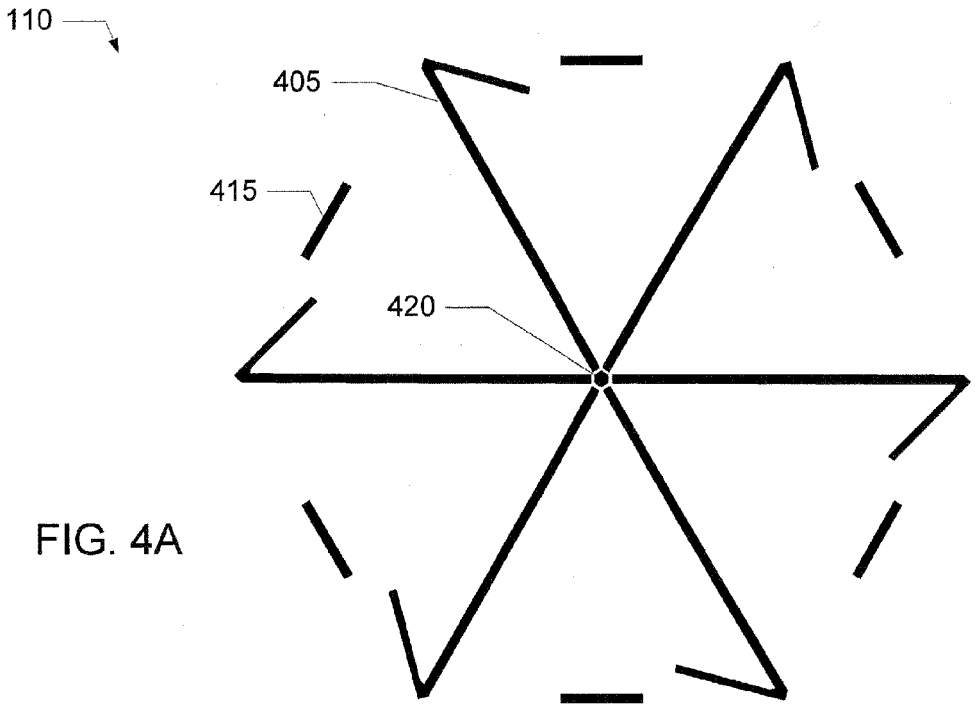
FIG. 4A and FIG. 4B illustrate an alternative embodiment of the planar antenna apparatus 110 of FIG. 1, in accordance with the present invention.
Figure 4B:
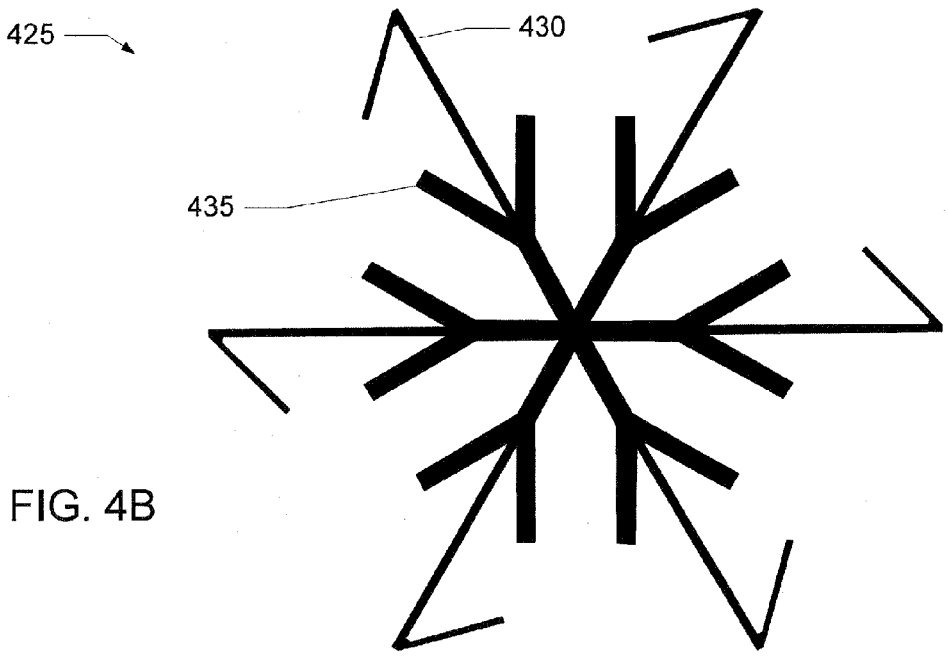

FIG. 4A and FIG. 4B illustrate an alternative embodiment of the planar antenna apparatus 110 of FIG. 1, in accordance with the present invention. On the first side of the substrate as shown in FIG. 4A, the planar antenna apparatus 110 includes a radio frequency feed port 420 and six antenna elements (e.g., the antenna element 405). On the second side of the substrate, as shown in FIG. 4B, the planar antenna apparatus 110 includes a ground component 425 incorporating a number of Y-shaped reflectors 435. It will be appreciated that a portion (e.g., the portion 430) of the ground component 425 is configured to form an arrow-shaped bent dipole in conjunction with the antenna element 405. Similarly to the embodiment of FIG. 2, the resultant bent dipole has a directional radiation pattern. However, in contrast to the embodiment of FIG. 2, the six antenna element embodiment provides a larger number of possible combined radiation patterns.

Similarly with respect to FIG. 2, the planar antenna apparatus 110 of FIG. 4 may optionally include one or more directors (not shown) and/or one or more gain directors 415. The directors and the gain directors 415 comprise passive elements that concentrate the directional radiation pattern of the antenna elements 405. In one embodiment, providing a director for each antenna element yields an additional 1-2 dB of gain for each element. It will be appreciated that the directors and/or the gain directors 415 may be placed on either side of the substrate. It will also be appreciated that additional directors and/or gain directors may be included to further concentrate the directional radiation pattern of one or more of the antenna elements 405.

An advantage of the planar antenna apparatus 110 of FIGS. 2-4 is that the antenna elements (e.g., the antenna elements 205*a*-205*d*) are each selectable and may be switched on or off to form various combined radiation patterns for the planar antenna apparatus 110. For example, the system 100 communicating over the wireless link to the remote receiving node may select a particular configuration of selected antenna elements that minimizes interference over the wireless link. If the wireless link experiences interference, for example due to other radio transmitting devices, or changes or disturbances in the wireless link between the system 100 and the remote receiving node, the system 100 may select a different configuration of selected antenna elements to change the radiation pattern of the planar antenna apparatus 110 and minimize the interference in the wireless link. The system 100 may select a configuration of selected antenna elements corresponding to a maximum gain between the system and the remote receiving node. Alternatively, the system may select a configuration of selected antenna elements corresponding to less than maximal gain, but corresponding to reduced interference. Alternatively, all or substantially all of the antenna elements may be selected to form a combined omnidirectional radiation pattern.

A further advantage of the planar antenna apparatus 110 is that RF signals travel better indoors with horizontally polarized signals. Typically, network interface cards (NICs) are horizontally polarized. Providing horizontally polarized signals with the planar antenna apparatus 110 improves interference rejection (potentially, up to 20 dB) from RF sources that use commonly-available vertically polarized antennas.

Another advantage of the system 100 is that the planar antenna apparatus 110 includes switching at RF as opposed to switching at baseband. Switching at RF means that the communication device 120 requires only one RF up/down converter. Switching at RF also requires a significantly simplified interface between the communication device 120 and the planar antenna apparatus 110. For example, the planar antenna apparatus provides an impedance match under all configurations of selected antenna elements, regardless of which antenna elements are selected. In one embodiment, a match with less than 10 dB return loss is maintained under all configurations of selected antenna elements, over the range of frequencies of the 802.11 standard, regardless of which antenna elements are selected.

A still further advantage of the system 100 is that, in comparison for example to a phased array antenna with relatively complex phase switching elements, switching for the planar antenna apparatus 110 is performed to form the combined radiation pattern by merely switching antenna elements on or off. No phase variation, with attendant phase matching complexity, is required in the planar antenna apparatus 110.

Yet another advantage of the planar antenna apparatus 110 on PCB is that the planar antenna apparatus 110 does not require a 3-dimensional manufactured structure, as would be required by a plurality of "patch" antennas needed to form an omnidirectional antenna. Another advantage is that the planar antenna apparatus 110 may be constructed on PCB so that the entire planar antenna apparatus 110 can be easily manufactured at low cost. One embodiment or layout of the planar antenna apparatus 110 comprises a square or rectangular shape, so that the planar antenna apparatus 110 is easily panelized.

The invention has been described herein in terms of several preferred embodiments. Other embodiments of the invention, including alternatives, modifications, permutations and equivalents of the embodiments described herein, will be apparent to those skilled in the art from consideration of the specification, study of the drawings, and practice of the invention. The embodiments and preferred features described above should be considered exemplary, with the invention being defined by the appended claims, which therefore include all such alternatives, modifications, permutations and equivalents as fall within the true spirit and scope of the present invention.

What is claimed is:

1. A network peripheral device comprising:

a plurality of individually selectable antennas formed on a first side of a substrate;

a plurality of Y-shaped reflector formed on a second side of the substrate opposite to the first side, each Y-shaped reflector corresponding to one of the plurality of selectable antennas;

a radio frequency feed port configured to receive radio frequency signals generated by a communication device, wherein the plurality of individually selectable antennas form a radially symmetrical layout about the radio frequency feed port;

an antenna element selector configured to couple and decouple the radio frequency feed port to one or more of the plurality of individually selectable antennas, wherein a radiation pattern is changed based on the coupling and decoupling of the radio frequency feed port and the one or more of the plurality of individually selectable antennas, and wherein the radiation pattern is substantially omnidirectional when the radio frequency port is coupled to a subset of the plurality of individually selectable antennas; and a plurality of light emitting diodes (LEDs) each to be activated and deactivated depending on a selection and de-selection of respective antennas from among the plurality of individually selectable antennas by the antenna element selector.

2. The device of claim 1, wherein the network peripheral device includes an access point configured to communicate to one or more remote receiving nodes over a wireless link or network.

3. The device of claim 1, further comprising a modulator/demodulator that is communicatively coupled to the communication device, wherein the modulator/demodulator is configured to convert data received by the device into an RF signal to be transmitted to one or more remote receiving nodes.

4. The device of claim 1, wherein each LED is lit when a corresponding antenna among the plurality of individually selectable antennas is selected.

5. The device of claim 1, further comprising a ground component formed on the second side of the substrate, wherein a portion of the ground component is configured to form an arrow-shaped bent dipole in conjunction with one or more of the selectable antennas.

6. The device of claim 1, further comprising one or more directors and one or more gain directors.

7. The device of claim 6, wherein said one or more directors and one or more gain directors are formed on the first side of the substrate.

8. The device of claim 6, wherein said one or more directors and one or more gain directors are formed on the second side of the substrate.

9. The device of claim 5, wherein each antenna is coplanar with the ground component.

10. The device of claim 5, wherein the antenna element selector is mounted on a printed circuit board (PCB), and wherein the PCB is electrically coupled to the plurality of individually selectable antennas.

11. A method for providing a network peripheral device, the method comprising:

providing a plurality of individually selectable antennas on a first side of a substrate;

providing a plurality of Y-shaped reflector on a second side of the substrate opposite to the first side, each Y-shaped reflector corresponding to one of the plurality of selectable antennas;

receiving radio frequency signals generated by a communication device, by a radio frequency feed port, wherein the plurality of individually selectable antennas form a radially symmetrical layout about the radio frequency feed port;

coupling and decoupling the radio frequency feed port to one or more of the plurality of individually selectable antennas, by an antenna element selector to change a radiation pattern based on the coupling and decoupling of the radio frequency feed port and the one or more of the plurality of individually selectable antennas, wherein the radiation pattern is substantially omnidirectional when the radio frequency port is coupled to a subset of the plurality of individually selectable antennas; and activating and deactivating a plurality of light emitting diodes (LEDs), depending on a selection and de-selection of respective antennas from among the plurality of individually selectable antennas by the antenna element selector.

12. The method of claim 11, further comprising communicating with one or more remote receiving nodes over a wireless link or network by an access point included in the network peripheral device.

13. The method of claim 11, further comprising converting data received by the network peripheral device into an RF signal to be transmitted to one or more remote receiving nodes, by a modulator/demodulator that is communicatively coupled to the communication device.

14. The method of claim 11, further comprising activating each LED when a corresponding antenna among the plurality of individually selectable antennas is selected.

15. The method of claim 11, further comprising providing a ground component formed on the second side of the substrate, wherein a portion of the ground component is configured to form an arrow-shaped bent dipole in conjunction with one or more of the selectable antennas.

16. The method of claim 11, further comprising providing one or more directors and one or more gain directors.

17. The method of claim 16, wherein said one or more directors and one or more gain directors are formed on the first side of the substrate.

18. The device of claim 16, wherein said one or more directors and one or more gain directors are formed on the second side of the substrate.

19. The device of claim 15, wherein each antenna is coplanar with the ground component.

20. The device of claim 15, wherein the antenna element selector is mounted on a printed circuit board (PCB), and wherein the PCB is electrically coupled to the plurality of individually selectable antennas.

* * * * *